US009784538B2

(12) United States Patent
Sovine et al.

(10) Patent No.: US 9,784,538 B2
(45) Date of Patent: Oct. 10, 2017

(54) HIGH CALIBER TARGET

(71) Applicant: Action Target Inc., Provo, UT (US)

(72) Inventors: James Sovine, Orem, UT (US); Devin Anderson, Orem, UT (US)

(73) Assignee: Action Target Inc., Provo, UT (US)

( * ) Notice: Subject to any disclaimer, the term of this patent is extended or adjusted under 35 U.S.C. 154(b) by 0 days.

(21) Appl. No.: 14/996,150

(22) Filed: Jan. 14, 2016

(65) Prior Publication Data

US 2016/0209182 A1 Jul. 21, 2016

Related U.S. Application Data

(60) Provisional application No. 62/104,492, filed on Jan. 16, 2015.

(51) Int. Cl.
*F41J 1/10* (2006.01)

(52) U.S. Cl.
CPC ..... *F41J 1/10* (2013.01)

(58) Field of Classification Search
CPC . F41J 1/00; F41J 1/10; F41J 7/00; F41J 7/02; F41J 7/04; G09F 7/18; G09F 2007/1804; G09F 2007/1856
USPC ..... 273/403–410, 390–392
See application file for complete search history.

(56) References Cited

U.S. PATENT DOCUMENTS 157,335 A 12/1874 Lyon
429,942 A 6/1890 McBride
483,060 A 9/1892 Holm
570,820 A 11/1896 Scratton
631,175 A 8/1899 Parnall
840,610 A 1/1907 Easdale
879,670 A 2/1908 Petry
937,733 A 10/1909 Worrell
950,101 A 2/1910 Green
960,085 A 5/1910 Giles
960,892 A 6/1910 Gates
1,025,944 A * 5/1912 Elliott ..... F41J 7/04 273/390
1,036,879 A 8/1912 Miner
1,207,456 A 12/1916 Whelan
1,348,283 A 8/1920 Koehl
1,424,632 A 8/1922 Fenton
1,517,461 A 8/1924 Robinson
(Continued)

FOREIGN PATENT DOCUMENTS

GB 2136932 9/1984
GB 2 187 270 9/1987

OTHER PUBLICATIONS

Caswell International Corp., Product Literature, Copyright 2002.
(Continued)

*Primary Examiner* — Mark Graham
(74) *Attorney, Agent, or Firm* — Durham Jones & Pinegar; Randall B. Bateman; Sarah W. Matthews

(57) ABSTRACT

A high caliber target includes a target plate and a stand. The target plate may be mounted on and removed from the stand. In accordance with one embodiment, the target plate can be mounted and removed without tools. In accordance with one embodiment, the target plate is presented to the shooter without joints or edges which could promote ricochets back toward the shooter. In accordance with another embodiment, the target plate can pivot on impact relative to the stand.

10 Claims, 4 Drawing Sheets

(56) References Cited

U.S. PATENT DOCUMENTS 1,540,802 A 6/1925 Ordway
1,543,605 A 6/1925 Gavard
1,559,171 A 10/1925 Knowles
1,657,931 A 7/1926 Krantz
1,640,954 A 8/1927 Mach
1,738,874 A 12/1929 Domingo
1,831,289 A 11/1931 Dally
2,048,155 A 1/1935 Armantrout
2,008,359 A 7/1935 Lamb
2,039,552 A 5/1936 Reynolds
2,085,933 A 7/1937 Vaughan
2,104,171 A 1/1938 Schwerin
2,179,471 A 11/1939 Lee
2,284,510 A 5/1942 Cates
2,290,297 A 7/1942 Smith
2,344,829 A 3/1944 McAvoy
2,372,111 A 3/1945 Norberg
2,538,118 A 6/1949 Miller
2,494,210 A 1/1950 Robinson
2,535,280 A 12/1950 Gartrell
2,586,958 A 2/1952 Keller
2,587,042 A 2/1952 Haiselup
2,613,934 A 10/1952 Tabler
2,706,634 A 4/1955 Van Valkenburg
2,809,836 A 10/1957 Musser
2,819,903 A 1/1958 Saunders
2,838,309 A 6/1958 Merz et al.
2,905,469 A 9/1959 Taylor
2,957,694 A 10/1960 Barber
2,967,712 A 1/1961 Breitenfeldt
3,014,725 A 12/1961 Lewis
3,032,808 A 5/1962 Fleming
3,064,976 A 11/1962 Kuhn
3,087,701 A 4/1963 Wallace
3,103,362 A 9/1963 Elofson
3,113,773 A 12/1963 Ripepe
3,140,874 A 7/1964 Jensen et al.
3,233,904 A 2/1966 Gillam et al.
3,348,843 A 10/1967 Stanley
3,363,900 A 1/1968 Cadle
3,385,405 A 5/1968 Cullen
3,392,980 A 7/1968 Ortega
3,422,538 A 1/1969 Panissidi
3,471,153 A 10/1969 Baumler
3,510,133 A 5/1970 Gretzky
3,515,388 A 6/1970 Zachmeier
3,540,729 A 11/1970 Rahberger
3,601,353 A 8/1971 Dale
3,614,102 A 10/1971 Nikoden, Sr.
3,638,894 A * 2/1972 Leutenegger ..... F16B 2/246 211/110
3,720,411 A 3/1973 Vogelaere
3,755,942 A * 9/1973 Samsing ..... G09F 1/06 40/606.01
3,802,098 A 4/1974 Sampson et al.
3,914,879 A 10/1975 Taylor, III
3,992,007 A 11/1976 Seeman
4,072,313 A 2/1978 Murso et al.
4,076,247 A 2/1978 Kim et al.
4,084,299 A 4/1978 Noda
4,086,711 A 5/1978 Gammarino et al.
4,177,835 A 12/1979 Paley
4,205,847 A 6/1980 Steiger et al.
4,228,569 A 10/1980 Snyder
4,232,867 A 11/1980 Tate, Sr.
4,249,743 A 2/1981 Lee
4,288,080 A 9/1981 Laporte et al.
4,294,452 A 10/1981 Schlotter et al.
4,340,370 A 7/1982 Marshall et al.
4,361,330 A 11/1982 Scharer
4,395,045 A 7/1983 Baer
4,440,399 A 4/1984 Smith
4,501,427 A 2/1985 Payne
4,506,416 A 3/1985 Ohminato et al.
4,540,182 A 9/1985 Clement
4,546,984 A 10/1985 Towle et al.
4,614,345 A 9/1986 Doughty
4,657,261 A 4/1987 Saunders
4,691,925 A * 9/1987 Scholem ..... F41J 1/10 248/159
4,706,963 A 11/1987 Geuss
4,726,593 A 2/1988 Wade
4,739,996 A 4/1988 Vedder
4,743,032 A 5/1988 Summers et al.
4,807,888 A 2/1989 Pidde
4,844,476 A 7/1989 Becker
4,890,847 A 1/1990 Cartee et al.
4,898,391 A 2/1990 Kelly et al.
4,911,453 A 3/1990 Essex et al.
4,913,389 A 4/1990 McCracken
4,953,875 A 9/1990 Sudit
4,979,752 A 12/1990 Fosseen
5,054,723 A 10/1991 Arnold
5,145,133 A 9/1992 France
5,163,689 A 11/1992 Bateman
5,213,336 A 5/1993 Bateman
5,232,227 A * 8/1993 Bateman ..... F41J 7/04 273/392
5,240,258 A 8/1993 Bateman
5,242,172 A 9/1993 Bateman
5,257,790 A 11/1993 Meadows
5,263,721 A 11/1993 Lowrance
5,277,432 A * 1/1994 Bateman ..... F41J 1/10 273/407
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,400,692 A 3/1995 Bateman
5,433,451 A 7/1995 De Vries
5,535,662 A 7/1996 Bateman
5,598,996 A 2/1997 Rath
5,605,335 A 2/1997 Simpson
5,618,044 A 4/1997 Bateman
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,676,378 A 10/1997 West
5,695,196 A 12/1997 Yanosky
5,765,832 A 6/1998 Huff
5,802,460 A 9/1998 Parvulescu et al.
5,811,718 A 9/1998 Bateman
5,822,936 A 10/1998 Bateman
5,829,753 A 11/1998 Wiser
5,865,439 A 2/1999 Marcuson
5,906,552 A 5/1999 Padilla
5,907,930 A 6/1999 Ricco
5,934,678 A 8/1999 Theissen et al.
5,947,477 A 9/1999 Turnipseed
5,950,283 A 9/1999 Sato
5,951,016 A 9/1999 Bateman
5,963,624 A 10/1999 Pope
5,967,523 A 10/1999 Brownlee
5,988,645 A 11/1999 Downing
6,018,847 A 2/2000 Lu
6,109,614 A 8/2000 Ciarcia
6,223,029 B1 4/2001 Stenman et al.
6,230,214 B1 5/2001 Liukkonen et al.
6,283,756 B1 9/2001 Danckwerth et al.
6,289,213 B1 9/2001 Flint et al.
6,308,062 B1 10/2001 Chien et al.
6,311,980 B1 11/2001 Sovine et al.
6,322,444 B1 11/2001 Matsui et al.
6,325,376 B1 12/2001 Elliott et al.
6,328,651 B1 12/2001 Lebensfeld et al.
6,332,243 B1 12/2001 Kim
6,378,870 B1 4/2002 Sovine
6,398,215 B1 6/2002 Carroll
6,463,299 B1 10/2002 Macor
6,478,301 B1 11/2002 Witmeyer

(56) References Cited

U.S. PATENT DOCUMENTS 6,484,990 B1 11/2002 Marshall
6,502,820 B2 1/2003 Slifko
6,533,280 B1 3/2003 Sovine et al.
6,543,778 B2 4/2003 Baker
6,575,753 B2 6/2003 Rosa et al.
6,588,759 B1 7/2003 Bateman
6,679,795 B2 1/2004 Ouimette et al.
6,718,596 B2 4/2004 Kohlstrand et al.
6,728,546 B1 4/2004 Peterson et al.
RE38,540 E 6/2004 Bateman
6,761,357 B2 7/2004 Witt
6,776,418 B1 8/2004 Sovine et al.
6,808,177 B2 10/2004 Dehart
6,808,178 B1 10/2004 Sovine
6,896,267 B1 5/2005 Le Anna
6,975,859 B1 12/2005 Lambert et al.
6,994,347 B2 2/2006 Tessel et al.
6,994,348 B2 2/2006 Lambert et al.
6,994,349 B2 2/2006 Lambert et al.
7,128,321 B1 10/2006 Brown
7,134,977 B2 11/2006 Campbell et al.
7,140,615 B1 11/2006 Sovine et al.
7,175,181 B1 2/2007 Bateman et al.
7,194,944 B2 3/2007 Lambert et al.
7,201,376 B2 4/2007 Kuosa
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,302,768 B2 * 12/2007 Gajdacs ..... G09F 21/04 40/591
7,303,192 B2 12/2007 Marshall et al.
7,306,230 B2 12/2007 Lambert et al.
7,322,771 B1 1/2008 Marshall et al.
7,427,069 B2 9/2008 Bateman et al.
7,431,302 B2 10/2008 Bassett et al.
7,469,903 B2 12/2008 Marshall et al.
7,497,441 B2 3/2009 Marshall et al.
7,503,250 B2 3/2009 Lambert et al.
7,556,268 B2 7/2009 Bateman et al.
7,653,979 B2 2/2010 Bateman et al.
7,775,526 B1 8/2010 Lambert et al.
7,793,937 B2 9/2010 Bateman et al.
7,815,192 B1 * 10/2010 Kreiman ..... F41J 7/04 273/390
7,914,004 B2 3/2011 Wright et al.
7,950,666 B2 5/2011 Stincelli et al.
8,016,291 B2 9/2011 Wright et al.
8,091,896 B2 1/2012 Lambert et al.
8,128,094 B2 3/2012 Bateman et al.
8,162,319 B2 4/2012 Stincelli et al.
8,276,916 B2 10/2012 Bateman et al.
8,469,364 B2 6/2013 Bassett et al.
8,485,529 B2 7/2013 Bateman et al.
8,550,465 B2 10/2013 Wright et al.
8,579,294 B2 11/2013 Wright et al.
8,684,361 B2 * 4/2014 Henson ..... F41J 1/01 273/389
8,713,829 B1 * 5/2014 Crofford ..... G09F 15/0037 40/607.01
8,813,401 B2 * 8/2014 Diercks ..... F41J 1/10 273/407
8,827,273 B2 9/2014 John et al.
9,217,623 B2 12/2015 Sovine et al.
9,228,810 B2 1/2016 Bareman et al.
9,574,855 B2 2/2017 Davis
2005/0001381 A1 * 1/2005 Lambert ..... F41J 7/04 273/348
2005/0022658 A1 2/2005 Bateman
2005/0034594 A1 2/2005 Parks et al.
2006/0107985 A1 5/2006 Sovine
2006/0234069 A1 10/2006 Sovine et al.
2006/0240388 A1 10/2006 Marshall et al.
2006/0240391 A1 10/2006 Sovine et al.
2006/0290063 A1 12/2006 Hagar
2006/0290064 A1 12/2006 Hagar
2007/0072537 A1 3/2007 Bateman et al.
2007/0102883 A1 5/2007 Parks et al.
2008/0185786 A1 * 8/2008 Loveland ..... F41J 7/04 273/391
2008/0277876 A1 11/2008 Riley
2009/0014961 A1 1/2009 Bateman et al.
2009/0206551 A1 8/2009 Parks et al.
2010/0311015 A1 12/2010 Sovine et al.
2011/0233869 A1 9/2011 John et al.
2012/0187631 A1 7/2012 John et al.
2012/0193872 A1 8/2012 Henson et al.
2012/0247314 A1 10/2012 Bassett et al.
2012/0274028 A1 11/2012 Sudbeck et al.
2013/0106059 A1 * 5/2013 Larue ..... F41J 1/10 273/407
2013/0207347 A1 8/2013 Sovine et al.
2015/0260486 A1 * 9/2015 Trimbath ..... F41J 7/04 273/407
2015/0276356 A1 * 10/2015 Cesternino ..... F41J 9/02 273/370
2015/0292842 A1 * 10/2015 Pixton ..... F41J 1/10 273/407
2015/0330747 A1 * 11/2015 Ferrell ..... F41J 1/10 273/407
2015/0330748 A1 11/2015 Anzalone

OTHER PUBLICATIONS

Duelatron, Product Literature 1995.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Metal Spinning Target, Inc., Dueling Trees, Jul. 8, 2003.
Mike Gibson Manufacturing, Dueling Tree, Jul. 8, 2003.
Outwest MFG. Products, Product Literature, Jul. 8, 2003.
Porta Target, Product Literature, Circa 2000.
Shootrite, Tactical Training Target, published prior to Apr. 4, 2005.

* cited by examiner

HIGH CALIBER TARGET

THE FIELD OF THE INVENTION

The present invention relates to targets used for target practice. More specifically, the present invention relates to a target which can withstand high caliber rounds and which may be portable.

BACKGROUND

In order to maintain proficiency in the use of firearms, it is common for law enforcement officers, members of the military and sportsmen to engage in target practice. While many perceive target practice as simply a method for improving accuracy, it is important for law enforcement officers, members of the military and the like to conduct target practice in scenarios which improve timing and the ability to make split-second decisions on whether or not to fire. Such split-second decisions can mean the difference between life and death both for the officer or soldier and those around them. For example, a police officer who fires too quickly may shoot an unarmed person. If he or she delays too long, however, a perpetrator may shoot a bystander.

In the military context a sniper must often make a split second decision on whether to fire at a target. The person could be an enemy combatant holding a rocket-propelled grenade or simply a person carrying a pipe. To simulate different scenarios, it is often desirable to move one or more targets around. For example, target one may be an enemy combatant, and targets two and three are innocent civilians. Training is often improved by subjecting the shooter numerous different scenarios to prevent expectancy of the proper response.

While there are a wide variety of targets which are useful with smaller caliber rounds, such as a 0.223 or similar round, there are a more limited number of targets which are useful with high caliber rounds when a much larger projectile is fired into the target. For example, some machine guns and many sniper rifles fire a .50 BMG round (12.7×99 mm NATO), in which the weight of the projectile is typically about 620-710 grains (40-46 grams). Thus, the weight of the projectile used in these high caliber rounds can easily be 10 times that of the common infantry rifle.

Stopping a .50 BMG round presents a challenge at shooting ranges, especially where the targets are desired to be mobile. Most targets which will handle more common rounds, such as 30-06 and below, can be damaged by higher caliber rounds such as the .50 BMG. Thus, either the target is damaged by the impact of the projectile, or the target is so large and bulky as to be difficult to move.

While attempts at portable targets that will withstand .50 BMG rounds have been made, some are prone to falling over when impacted by the projectile. Others leave exposed hardware or joints or edges which can create a ricochet risk which is of particular concern with such a high powered round.

Thus there is a need for an improved target which can be used with high caliber rounds with little or no damage, provides little risk of ricochet, and remains transportable about a shooting range, etc.

SUMMARY OF THE INVENTION

Embodiments of an improved target and associated methods are disclosed below. According to some configurations, the target system includes a target plate having a mounting bracket system attached thereto, and a stand which engages the mounting bracket to hold the target plate in position during use.

In accordance with one aspect of the disclosure, the mounting bracket system attached to the target plate may be provided with a first mount in the form of a mounting bracket and a second mount in the form of a second mounting bracket. While both the first mounting bracket and the second mounting bracket may engage the stand, the second mounting bracket engages the stand in such a manner that the mounting bracket may slide forwardly and rearwardly with respect to the stand. Thus, when the target plate is impacted by a high caliber projectile, the target plate can pivot with respect to the stand so that a portion of the kinetic energy of the projectile is consumed in pivoting the target plate upon impact.

In accordance with another aspect of the invention, the target stand engages the mounting brackets at at least two spaced apart locations. The spaced apart engagement helps to prevent the target plate from being turned sideways when impacted by the projectile.

In accordance with another aspect of the invention, the mounting brackets attached to the target plate are configured to slide onto and off of the stand without the need for any tools to thereby allow for tool-less mounting and removal of the target plate on the stand. This, in turn, facilitates the target being disassembled, moved and reassembled without the need for tools.

It will be appreciated that the present invention provides various aspects and different embodiments provide different advantages. Thus, it will be appreciated that each embodiment need not provide all aspects or advantages of the present invention while still falling within the general scope of the invention as set forth in the appended claims.

BRIEF DESCRIPTION OF THE DRAWINGS

Various embodiments and features of target systems are shown and described in reference to the following numbered drawings.

Figure 1:
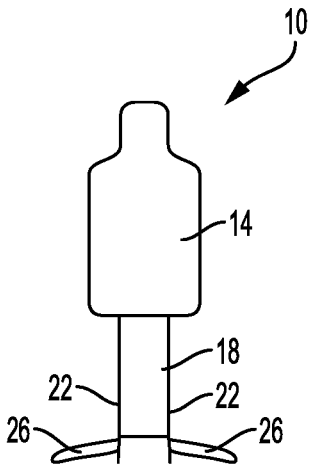
FIG. 1 shows a front view of an exemplary embodiment of a high caliber target made in accordance with principles of the present disclosure.

It will be appreciated that the drawings are illustrative and not limiting of the scope of the invention which is defined by the appended claims. The embodiments shown accomplish various aspects of the invention. It is appreciated that it is not possible to clearly show each element and aspect of an invention in a single figure, and as such, multiple figures are presented to separately illustrate the various details of embodiments of target systems in greater clarity. Several aspects from different figures may be used in accordance with target systems in a single structure. Similarly, not every embodiment need accomplish all advantages of various embodiments of target systems.

DETAILED DESCRIPTION

The invention and accompanying drawings will now be discussed in reference to the numerals provided therein so as to enable one skilled in the art to practice the present invention. The skilled artisan will understand, however, that the apparatuses, systems and methods described below can be practiced without employing these specific details, or that they can be used for purposes other than those described herein. Indeed, they can be modified and can be used in conjunction with products and techniques known to those of skill in the art in light of the present disclosure. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Furthermore, the described features, structures, or characteristics of configurations of the invention may be combined in any suitable manner in one or more configurations. In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

Before the present invention is disclosed and described in detail, it should be understood that the present disclosure is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or configurations shown unless expressly indicated as such. Likewise, the discussion of any particular aspect of the invention is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a channel" may include one or more of such channels, and reference to "the backing" may include reference to one or more of such backings.

As used herein, the term "substantially" refers to the complete or nearly complete extent or degree of an action, characteristic, property, state, structure, item, or result to function as indicated. For example, an object, such as tubing, that is "substantially" enclosed would mean that the object is either completely enclosed or nearly completely enclosed. The exact allowable degree of deviation from absolute completeness may in some cases depend on the specific context, such that enclosing nearly all of the length of a piece of tubing would be substantially enclosed, even if the distal end of the structure enclosing the tubing had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Turning now to FIG. 1 there is shown a front view of an exemplary embodiment of a high caliber target, generally indicated at 10, made in accordance with principles of the present invention. The high caliber target 10 includes a target plate 14 and a stand 18. The target plate 14 will typically be made from hardened steel, such as AR500 or AR550, having a thickness of $3/8^{th}$ of an inch or greater. It will be appreciated that while soft steel could be used, it would quickly be damaged by the high velocity projectiles and a thicker piece would need to be used.

The target plate 14 may be of any desired shape. For example, in FIG. 1 the target plate 14 has the general shape of an FBI-Q silhouette training target. Other common shapes may include a FBI-QIT-G, a B-27, a Dunbar Armored Qualification Target, etc., or other shapes which resemble likely targets. If desired, markings could be painted on or otherwise applied to the target plate 14. (It will be appreciated that a .50 BMG round is used both by snipers to hit targets more than a mile away and to disable vehicles and the like).

The stand 18 is designed to hold the target plate 14 at a desired height. Additionally the target stand 18 includes two supports 22, the supports comprising mounting arms or mounting structures 34, which engage the target plate 14 to help minimize torsional movement when the impact of a projectile occurs to either side of the center of the plate. In some configurations, the target stand 18 may include one support 22 or mounting structure. The target stand 18 also includes a number of feet 26 which extend outwardly from the supports 22 to provide support and prevent the target plate 14 and target stand 18 from tipping over.

Figure 2:
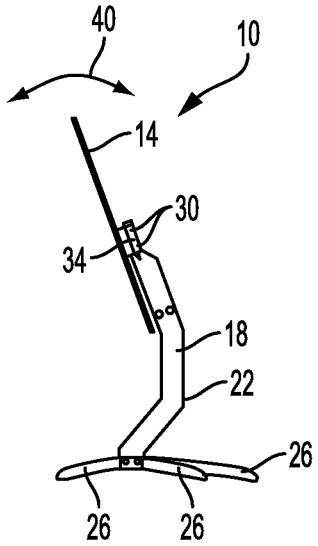
FIG. 2 shows a side view of the high caliber target of FIG. 1.

Turning now to FIG. 2, there is shown a side view of the high caliber portable target 10. As shown, the stand 18 is configured to hold the target plate 14 at an angle relative to vertical. The target plate 14 is typically held at an angle between 5 and 45 degrees, commonly between 10 and 25 degrees and most commonly at between about 15 and 20 degrees. The angle of the target plate 14 helps to deflect bullets downwardly after they have impacted the target plate 14 to thereby prevent ricochets back toward the shooter. It will be appreciated that the greater the angle relative the vertical, the easier it is for the target to deflect the energy of a projectile without damaging the target.

Mounting brackets 30 are attached to the back of the target plate 14 and receive one or more mounting arms or other mounting structures 34 of the stand 18. The mounting arms or mounting structures 34 may be attached to the upper end of the supports 22 of the stand 18, or the mounting structures 34 may be formed integrally to the supports 22. In accordance with one aspect of the invention, the mounting brackets 30 engage the mounting structures 34 in a manner that the mounting brackets 30 can be placed on and removed from the mounting structures 34 without the use of tools. This may be desirable when one desires to move the high caliber portable target 10 from one position to another. A target plate 14 made of AR550 hardened steel which is 18" by 40" and shaped as shown in FIG. 1 will weigh just about 100 pounds with the brackets and targets attached. Thus, to move the target 10, the target plate 14 may be removed, the stand 18 moved to the new designed location and then the target plate 14 remounted on the mounting structures 34 of the stand 18. A single person can relocate the stand 18 if necessary.

Figure 3:
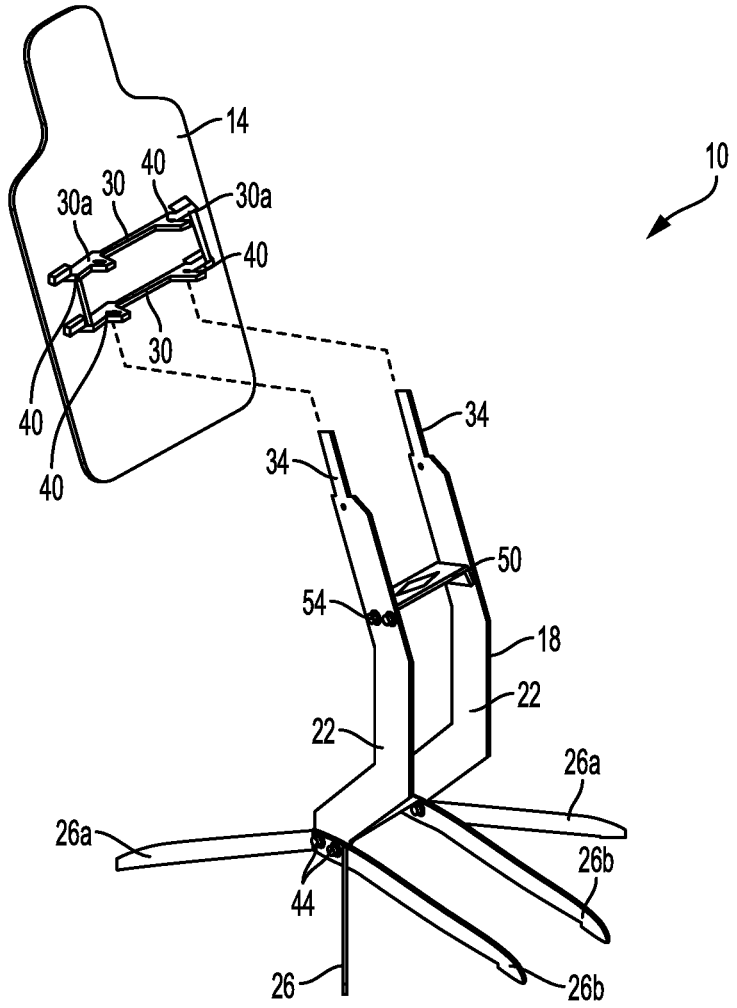
FIG. 3 shows a partially exploded view of the high caliber target shown in FIG. 1.

Turning now to FIG. 3, there is shown a partially exploded view of the high caliber portable target 10. The target plate 14 has been removed from the stand 18 to better show the engagement between the two structures. As was mentioned previously, the target plate 14 may have two or more mounting brackets 30 attached thereto. The mounting brackets 30 are designed to engage the stand 18. In one preferred embodiment this is done so that the mounting brackets 30 can be mounted on the stand 18 and removed therefrom without the use of tools.

Each of the mounting brackets 30 may include projections 30*a* with slots 40 which receive the mounting arms or structures 34 of the stand 18. In accordance with one aspect of some embodiments of the invention, the slots 40 on one of the mounting brackets 30 may be larger than the slots on the other mounting bracket. For example, as shown in FIG. 3 (and most visible in FIG. 4), the slots 40 on the upper mounting bracket are longer than the slots on the lower mounting bracket. When the mounting brackets 30 are mounted on the mounting arms 34 of the stand 18, the larger slots 40 in the upper mounting bracket will allow the upper mounting bracket to slide relative to the mounting arms 34. This effectively allows the target plate 14 to pivot with respect to stand 18 when impacted by a bullet. The amount of deflection allowed will be determined by the length of the slot 40 and the size of the mounting structure 34. For example, the slot 40 may be sufficiently long relative to the mounting structure 34 to allow the mounting bracket to slide so that the target plate 14 pivots between around 5 to 15 degrees.

Because of the weight of the target plate 14, pivoting of the plate 14 dissipates energy. The amount of energy consumed reduces the amount of energy which the stand 18 must withstand without tipping over. Thus, the likelihood that the high caliber portable target 10 will tip over when impacted is reduced because of the energy dissipated by pivoting of the target plate 14. Additionally, as can be seen in FIG. 2, the length of the feet 26 of the stand 18 is relatively large to provide additional support. Also shown in FIG. 2, the curved nature of the stand 18 helps to align the engagement between the mounting brackets 30 and mounting structures 34 above the engagement of the supports 22 with the feet 26. The feet 26 may be formed on each side by one bent piece 26*a* which is attached to the supports 22 of the stand 18 by bolts 44, and one straight piece 26*b* which is held to the supports by the same bolts. It will be appreciated that a similar configuration could be formed with a single piece forming the straight and bent portion, or with more than two pieces. The supports 22 may also be secured by a cross-support 50 attached to the supports by bolts 54.

Figure 4:
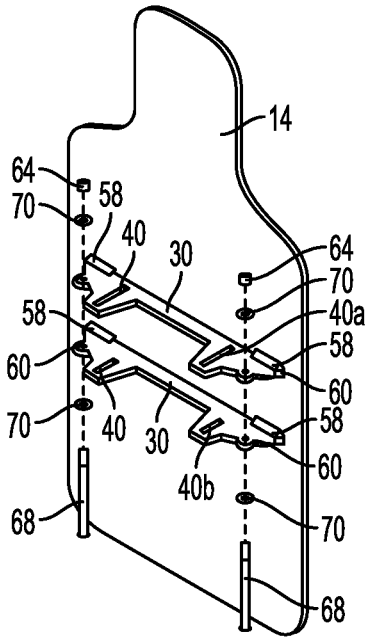
FIG. 4 shows a close-up view of the target plate and mounting bracket system.

Turning now to FIG. 4, there is shown a close-up view of the target plate 14 and the mount formed thereon by mounting brackets 30 and their associated structures. The mounting brackets 30 may be welded (as represented at 58) to the target plate 14. As was discussed previously, the size of the slots 40*a* in one mounting bracket 30 may be larger than the size of the slots 40*b* in the other mounting bracket. This may be used to allow the target plate 14 to pivot. It will also be appreciated that other engagement arrangements could be used to allow the target plate 14 to pivot with respect to the stand when impacted by a bullet. For example, the slots 40 formed in the mounting brackets 30 could be the same size and the mounting structures 34 (FIG. 2) could be tapered or otherwise shaped to allow movement of one mounting bracket relative to the mounting structure while the other mounting bracket remains relatively still or moves to a lesser degree.

FIG. 4 also shows a pair of nuts 64 and bolts 68. The bolts 68 pass through openings 60 in the mounting brackets. When the nuts 64 are tightened on the bolts 68, the nuts and bolts help provide handles for gripping and moving the target plate 14. Washers 70 may also be used with the nuts 64 and bolts 68 if desired.

Figure 5:
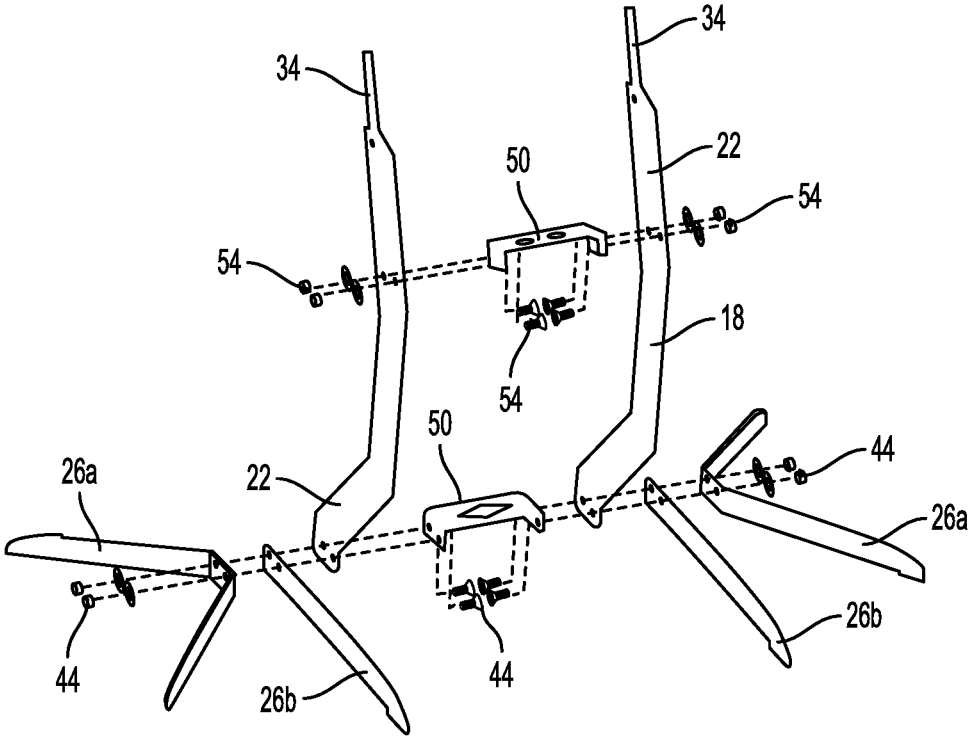
FIG. 5 shows an exploded view of the stand on which the target plate is mounted.

Turning now to FIG. 5, there is shown an exploded view of the stand 18. The stand 18 may be formed from a single support structure. However, the configuration shown in FIG. 5 may be advantageous for several reasons. First, the supports 22 are spaced apart by the cross-members 50 (two of which are shown in FIG. 5). The spacing of the supports 22 causes the mounting structures 34 to engage the mounting brackets 30 (FIGS. 2-4) a desirable distance from a center vertical plane. This helps to reduce torsion or turning of the target 10 when hit by a high velocity round at a position away from the center vertical plane. This is further enhanced by the rearward and outward spreading of the feet 26*a* and 26*b* which are attached near the bottom of the supports.

One advantage of the present configuration is that a pair of nuts and bolts 44 can be used to attach two different feet to the support 22 and to attach the cross-member 50 to the support, thereby reducing cost and materials. By simply removing four bolts the feet 26*a*, 26*b*, the cross-member 50 can be removed from the supports 22. Removing another four nuts and bolts 54 allows the other cross-member 50 to be removed. Thus, a sturdy stand can be formed from a relatively small amount of plate steel and bolts, and the stand can be readily disassembled for storage if the stand is not needed, or for transport if the target 10 is to be taken to a different location.

It will be appreciated that the stand 18 is likely to be hit occasionally by high velocity rounds which miss the target plate 14 (FIGS. 1-4). As shown, the stand can be formed from a relatively small amount of plate steel which will stand up to considerable impact from projectiles. The construction of the stand 18, however, also leaves a relatively small amount of profile which a bullet could strike and cause an undesirable ricochet. For example, in some high caliber targets, the stand engages the target plate in such a manner that joints or edges are left exposed which could cause a bullet to ricochet back toward the shooter. In the configuration shown herein, there is no joint or edge along the front of target plate 14 which could cause such a ricochet. Additionally, the stand is configured to provide minimal risk of ricochet in the event that the shooter misses the target plate 14 altogether and hits the stand 18 instead.

Thus there is disclosed a high caliber portable target. It will be appreciated that numerous changes may be made to the above-disclosed embodiments of target systems and associated methods without departing from the scope of the claims. The appended claims are intended to cover such modifications.

What is claimed is:

1. A high caliber portable target comprising:

a target plate having a first mounting bracket and a second mounting bracket attached thereto; and a stand having at least one mounting structure, the at least one mounting structure extending through the first mounting bracket and the second mounting bracket to attach the target plate to the stand, the first mounting bracket and the second mounting bracket being slidably mountable along the at least one mounting structure to allow the first mounting bracket and the second mounting bracket to be positioned on, retained and removed from the at least one mounting structure without tools; and wherein at least one of the first mounting bracket and the second mounting bracket extends rearwardly beyond the at least one mounting structure so as to allow said mounting bracket to slide rearwardly on the at least one mounting structure such that the target plate can deflect between 5 and 15 degrees toward vertical when impacted.

2. The high caliber portable target of claim 1, wherein the first mounting bracket has a plurality of slots and wherein the second mounting bracket has a plurality of slots and wherein the mounting structure of the stand comprises a first arm which extends through one slot in the first mounting bracket and through one slot in the second mounting bracket and a second arm, spaced apart from the first arm, the second arm extending through one slot on the first mounting bracket and one slot on the second mounting bracket so that the first arm and the second arm slidably engage the first mounting bracket and the second mounting bracket, respectively, and thereby support the target plate above a surface from which the stand extends.

3. The high caliber portable target of claim 2, wherein the plurality of slots in the second mounting bracket are larger than the plurality of slots in the first mounting bracket.

4. The high caliber portable target of claim 1, wherein the first mounting bracket and the second mounting bracket are welded to the target plate.

5. The high caliber portable target of claim 1, wherein the target plate has opposing lateral sides, and wherein the stand includes a first support having a mounting structure at an upper end thereof, and a second support having a mounting structure at an upper end thereof, the first support and the second support being spaced apart from each other so as to be positioned adjacent the opposing lateral sides of the target plate.

6. The high caliber portable target of claim 5, further comprising a plurality of cross-members attaching the first support to the second support.

7. The high caliber portable target of claim 1, wherein the target plate has a front side for being impacted by bullet and a rear side, the first mounting bracket and the second mounting bracket being attached to the rear side and do not extend forwardly of the front side of the target plate.

8. A target comprising a target plate, a first mounting bracket having a plurality of slots formed therein and a second mounting bracket having a plurality of slots formed therein, the first mounting bracket and the second mounting bracket being welded to the target plate, wherein the plurality of slots in the first mounting bracket are disposed in alignment with and generally in parallel with the plurality of slots in the second mounting bracket to facilitate a stand being advanced through the slots, and wherein the plurality of slots on the second mounting bracket are larger than the plurality of slots in the first mounting bracket.

9. The target of claim 8, wherein the plurality of slots in the second mounting bracket are longer than the plurality of slots in the first mounting bracket.

10. The target of claim 8, wherein the first mounting bracket and the second mounting bracket are attached to one side of the target plate and do not extend beyond an opposing side of the target plate.

* * * * *